United States Patent [19]

Knauer

[11] Patent Number: 4,770,014

[45] Date of Patent: Sep. 13, 1988

[54] LOCK

[76] Inventor: Oswald Knauer, Holzschuherring 46, 8520 Erlangen, Fed. Rep. of Germany

[21] Appl. No.: 118,147

[22] Filed: Nov. 6, 1987

[30] Foreign Application Priority Data

Nov. 12, 1986 [EP] European Pat. Off. ..... 86115737.8

[51] Int. Cl.[4] ..... E05B 27/06

[52] U.S. Cl. ..... 70/358; 70/402; 70/409; 70/419; 70/453; 70/454; 70/493

[58] Field of Search ..... 70/358, 364 A, 402, 70/403, 405, 406, 407, 409, 453, 454, 419

[56] References Cited

U.S. PATENT DOCUMENTS

| | | | |
|---|---|---|---|
| 3,974,670 | 8/1976 | Wolter | 70/419 |
| 4,104,893 | 8/1978 | Fois | 70/454 |
| 4,338,806 | 7/1982 | Cox | 70/417 |
| 4,343,126 | 8/1982 | Hofmann | 70/358 |

FOREIGN PATENT DOCUMENTS

| | | | |
|---|---|---|---|
| 1563400 | 3/1980 | United Kingdom | 70/358 |

*Primary Examiner*—Robert L. Wolfe

*Attorney, Agent, or Firm*—Jordan and Hamburg

[57] ABSTRACT

A lock has an outer casing and a lock cylinder rotatably mounted therein and having a coaxial keyway of round cross section plus several rows of radial bores to accommodate the tumblers and their springs, and also has a key which has notches on its outside profile for the engagement with the tumbler. The key has an equilateral polygonal bit cross section which matches the cross section of the keyhole in the front wall of the lock casing as well as a coaxial opening in the lock cylinder bottom, these cross sections of the keyhole and bottom opening being angularly offset from one another. The tip of the key bit has ramp surfaces corresponding to the rows of the tumblers, ascending toward the handle of the key and terminating each at one polygon face for the purpose of raising the tumblers, and the rows of notches are disposed between the polygon faces. The axial length of the polygonal cross section of the key is not greater than the length of the keyway in the lock cylinder and the adjoining portion of the key shaft is able to turn in the keyhole.

18 Claims, 2 Drawing Sheets

LOCK

Figure 1:
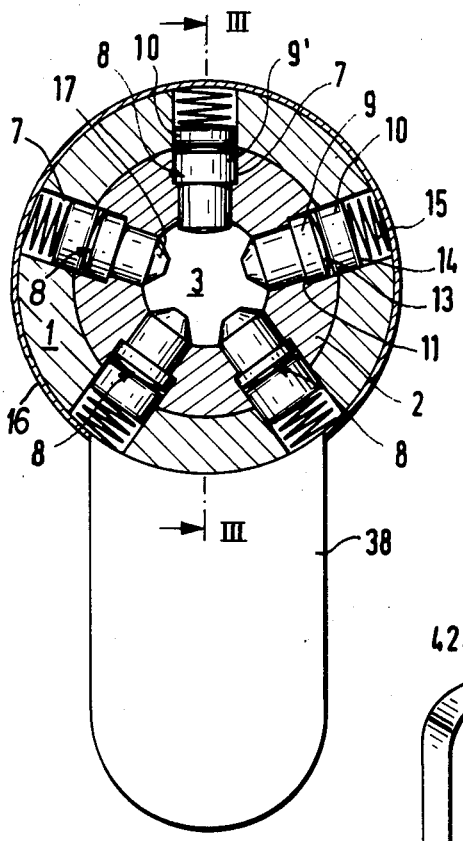

The invention relates to a lock having an outer casing and a lock cylinder rotatably mounted therein and having a coaxial keyway of round cross section plus several rows of radial bores to accommodate the tumblers and their springs, and also having a key which has notches on its outside profile for the engagement each of a tumbler.

It is known that the more rows of tumbler pins a lock cylinder has, the greater can be its variety of bit patterns. For each row of tumblers a corresponding row of notches is provided on the key to accommodate the tips of the pins. When the lock is introduced into the keyway the foremost tumblers in the lock perform the same number of radial movements, minus one, as there are notches in the corresponding row on the key. This is because the foremost tumbler falls successively into all the notches and, until it finally comes to rest in the notch of the key that is associated with it, it has to be raised again out of all the preceding notches into which it has fallen. The same applies to the next tumbler in this row, but one radial movement less, etc. The result is that the tumblers are subject to a great amount of wear. The nearer the tumblers are to the front of the lock, the more they are subject to wear. A consequence is the tumbler chatter that is often characteristic of such locks, along with noise and vibration in the operation of the key in the lock that is connected therewith.

It is the object of the invention to relieve these deficiencies of the known locks, thereby reducing wear and effectively increasing the security of such locks, and lastly to achieve an especially user-friendly, vibration-free lock construction without limiting thereby the number of locking variations. In a lock of the kind described above, the invention provides, for the solution of this problem, for the key to have an equilateral polygonal bit cross section which will match the cross section of the keyhole in the front wall of the lock casing as well as a coaxial opening in the lock cylinder bottom, these cross sections of the keyhole and bottom opening being angularly offset from one another, and for the tip of the key bit to have ramp surfaces corresponding to the rows of the tumblers, ascending toward the bow or handle of the key, and terminating each at one polygon face for the purpose of raising the tumblers, and the rows of notches being disposed between the polygon faces, while the axial length of the polygonal cross section of the key is not greater than the length of the lock cylinder without the bottom opening, and the portion of the key shaft adjoining the polygonal cross section being able to turn in the keyhole.

The configuration of the lock according to the invention utilizes a solid key of a polygonal bit cross section, in contrast to known key configurations, the term, "polygonal," in this connection being understood to refer to a plane figure of three or more sides. The cross section of this key bit corresponds to the cross section of the keyhole in the front of the casing which, in the lock according to the invention, covers the outer side of the lock cylinder. The polygonal cross section of the key bit, however, also matches the cross section of an opening coaxial with the keyhole in the bottom of the lock cylinder. The two polygonal cross sections of the opening and keyhole are, however, not congruent with one another in spite of their coaxial arrangement, being instead offset from one another at a certain angle. It follows necessarily therefrom that, if the key is to be engaged in the bottom opening, at first it must perform a rotation corresponding at least to this angular offset. At the tip of the key bit tumbler-raising ramp surfaces are provided which correspond to the rows of the tumblers and slope upward toward the bow or handle of the key, terminating one at each polygon face of the key cross section; on the other hand, the rows of the notches on the key, which receive the tips of the tumblers, are situated between the polygon faces, i.e., practically speaking, on an edge between two polygon faces. When the key is inserted into the keyway of round cross section, each ramp surface in the key tip successively passes under all tumblers in each row and raises them onto the polygon surface running parallel to the key axis without allowing the tumblers to fall into a notch because the notches are not disposed on the polygon faces of the key but but on a line between two adjoining faces. Since the polygonal key is not rotatable in the keyhole since the latter has the same polygonal cross section, it can be enter into the lock only until it reaches the bottom of the lock cylinder, without being able to engage in the bottom opening, since the cross section of the latter, though it corresponds to the key cross section, is offset at an angle therefrom. If the key is now rotated by a certain angular amount about its longitudinal axis, all of the tumblers of the rows of tumblers will again simultaneously be lifted onto a longitudinal edge of the polygonal cross section of the key in the immediate axial vicinity of the notch associated with the individual tumbler. This key rotation corresponds to the angular offset between the keyhole and the bottom opening. Since the tumblers are, in a known manner, subjected to the action of spring forces directed at the lock axis, the tips of the tumblers now resting on the notched edge push the key forward into the bottom opening, so that they fall by themselves into the notches associated with them. It follows that, in the lock according to the invention, each tumbler is lifted only once, but in two steps, to the maximum height in the radial direction before it then drops into the associated notch in the key. The movements of the tumblers are therefore reduced to a minimum and thus wear is effectively reduced, which adds to the life of the lock and to the reliability of its operation during its useful life. The turning of the key within the lock is made possible by the limited length of the polygonal cross section and the rotatability of the adjoining portion of the key shaft within the keyhole.

The reverse process takes place when the key is withdrawn. Here, again, each tumbler is lifted only once, namely out of the notch in a first step by the axial movement of the key, while the tip of the key simultaneously comes out of the bottom opening. If the key is then again turned in the keyway by a certain angular amount about its longitudinal axis the tumblers in each row will come onto one of the polygon faces of the key bit. If the key is now pulled further out, one tumbler after the other will slide radially inwardly down the ramp surface at the tip of the key to its given inner end position. The matching of the cross section of the key with the opening in the bottom of the lock cylinder enables the lock cylinder to be driven by the turning key after the key has reached its axial end position within the lock and the tip of the key has entered into the bottom opening.

Figure 5:
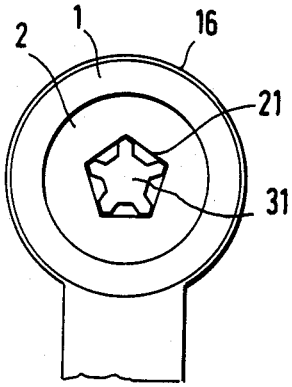
Figure 6:
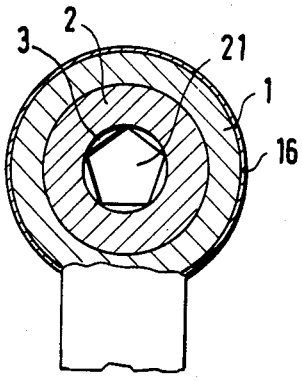
Figure 7:
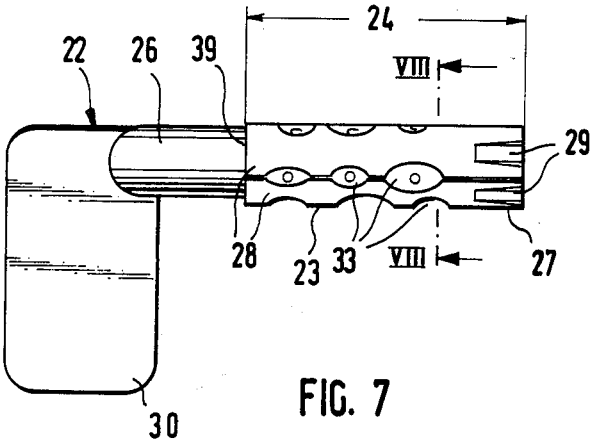
Figure 8:
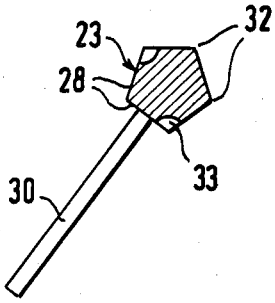
Figure 9:
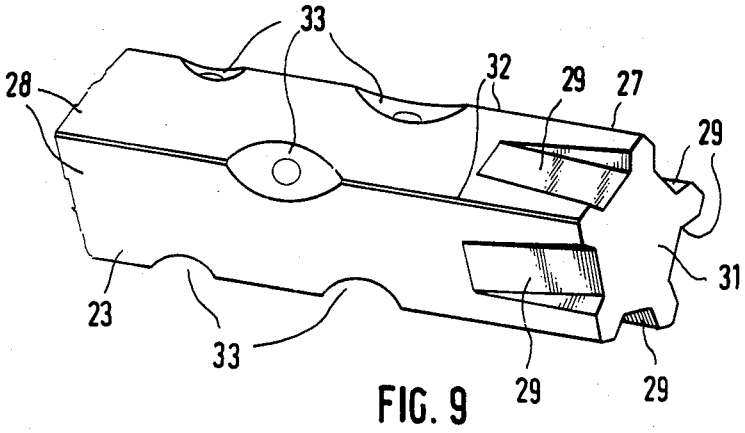

The corresponding key 22 has a bit 23 also of pentagonal cross section (see FIG. 8), the equilateral pentagon of this cross section approximately matching that of the keyhole 5 and of the bottom opening 21 of the lock cylinder 2. The axial length 24 of the pentagonal bit 23 of the key 22 corresponds approximately to the length 25 of the keyway 3 in the lock cylinder 2 all the way to the bottom 20. The adjoining shaft portion 26 of the key 22 is of round cross section in this embodiment, and can rotate in the keyhole 5. In the area of the tip 27 the key bit 23 has one ramp surface 29 for each flat 28 of the pentagon, which rises toward the handle 30 of the key and terminates at a pentagon face 28. This gives the end face 31 of the key bit 23 a star shape, as represented in FIGS. 5 and 9. On each edge 32 of this pentagonal bit 23 there is a row of notches 33 each of which is associated with one of the tumbler pins 8.

On the inside of the casing end wall 4, between the latter and the end face 6 of the lock cylinder 2, an annular disk 34 of hard metal is rotatably mounted on friction or ball bearings. A corresponding hard metal disk 35 is provided on the back of the lock cylinder bottom 20. This disk has a central bore 36 for the lock coupling. If desired, the locking parts 10 of the individual tumbler pins 8 can be made of hard metal and can be disposed in an axially fixed manner in their radial bore 7, as is the case, for example, with the guiding part 9′ in FIG. 1, whose key faces 28 extend flush into the keyway 3 so that the guidance of the key in the turning direction is possible only when the key is in a perpendicular position, by virtue of a recess situated on the key edge 32.

Figure 2:
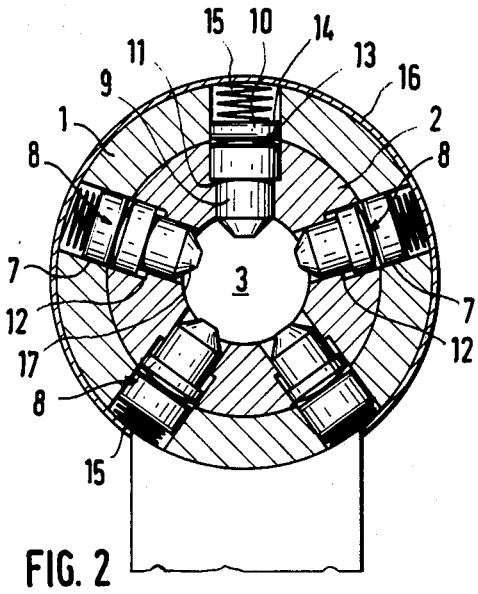

The operation of the lock is as follows:

The tip 27 of the key 22 is introduced in a predetermined rotatory position into the keyhole 5. The key bow or handle 30 thus assumes a tilt with respect to the casing projection 38. Upon introduction into the keyway 3, the tips 17 of the foremost tumbler pins 8 of all rows run onto the ramp surfaces 29 of the key tip 27 and are thus raised to the level of the pentagon faces 28 of the key bit 23. This is repeated for each additional tumbler pin 8 that follows in the rows, until all the tumbler pins 8 of all rows are resting on one of the pentagon faces 28. At this point the end face 31 of key bit 23 encounters the bottom 20 of the lock cylinder 2. The key tip 27, however, cannot engage in the opening 21 in the cylinder bottom because, due to the previous guidance by the keyhole 6, it is at an angle that is 36° off from this opening 21 and the spring forces acting through the tips 17 of the tumbler pins 8 on the pentagon faces 28 of the key bit 23 act against any turning of the key. On the other hand, at this point the entire length 24 of the pentagonal bit 23 lies within the keyway 3, and the constricted portion 26 is situated within the pentagonal keyhole 5 in the casing end wall 4. By a forced turning of the key 22 about its longitudinal axis, all of the tumbler pins 8 are simultaneously raised an additional step, namely to the level of an edge 32 of the pentagonal bit 23. But the pentagon of the key tip 27 also rotates in front of the opening 21 in the cylinder bottom 20 such that the two elements are brought into line with one another. The compression of the springs of the tumbler pins 8 at this point reaches its maximum and forces the pins with their tips 17 each into a notch 33 in the key bit 23, so that the latter performs a short axial movement whereby the key tip 27 snaps into the bottom opening 21. Thus the key 22 is locked into the lock cylinder 2 and all of the movable tumbler pins 8 are engaged in the corresponding notches 33 in the key bit 23. This state is represented in FIG. 2. The guiding parts 9 of all tumbler pins 8 are thus within the lock cylinder 2 so that the latter can now turn with the key as the latter is rotated further.

To open this lock the procedure is reversed. In the predetermined rotational position of the lock cylinder, in which the radial bores in the lock cylinder 2 and in the casing 1 are in line with one another, the key 22 is pulled back by its handle 30 axially until the hexagonal tip 27 comes out of the bottom opening 21 in the lock cylinder 2. In this manner all the tumbler pins 8, insofar as they have fallen into the notches 33, are lifted against the action of their springs. At this time they rest on one of the longitudinal edges 32 of the bit 23. Any further key movement is blocked by the abutment of the shoulder 39 against the inside of the keyhole 5. Consequently, the key 22 is now turned back by an angle of 36° so that its pentagonal bit 23 is aligned with the pentagonal cross section of the keyhole 5 and can be completely withdrawn from the keyway 3. When the key is thus slightly turned the tumbler pins 8 drop down so that they rest on the pentagonal faces 28 of the key bit 23. When the key is withdrawn from the keyhole 5 the tumbler pins 8 follow one after the other in their row all the way to their innermost end position, as represented in FIG. 1, in which the locking parts 10 of the pins 8 lock the lock cylinder 2 against the casing 1.

Figure 10:
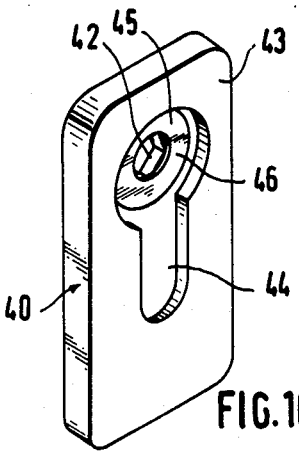

FIG. 10 represents an outer lock plate 40 which, if desired, can also consist of hard metal and is fastened by means of the screws or the like 41 from the inside of the door or the like bearing the lock. This lock plate 40 has an opening 42 which aligns with the keyhole 5 of the lock and, in the illustrated embodiment, also matches the contours of the keyhole 5. The inside 43 of this lock plate 40 has a recess 44 whose shape matches the front face of the lock and accommodates this front face in the installed position represented in FIG. 11.

Figure 11:
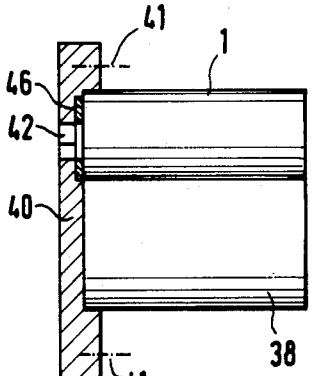
Figure 3:
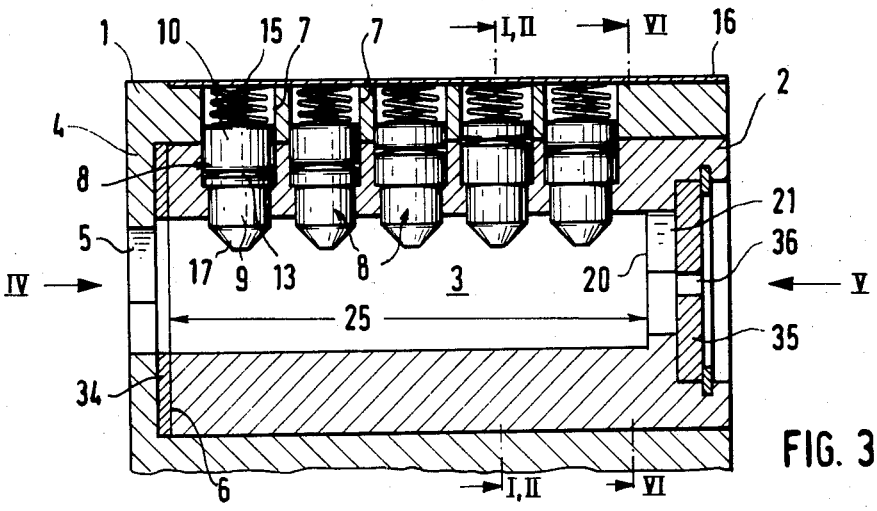
Figure 4:
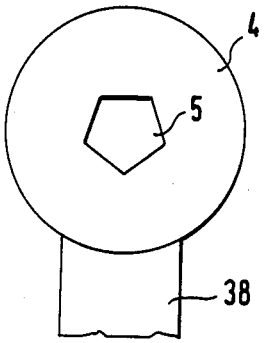

FIG. 11 shows that, in the area 45 of this recess 44 situated axially in front of the lock cylinder 2, a hard metal disk 46 is rotatably mounted on friction or ball bearings and effectively resists any attempt to drill through it.

I claim:

1. A lock comprising an external casing, said casing having an end wall with a first key hole opening, a lock cylinder rotatably mounted in said casing, said lock cylinder having an end section with a second key hole opening, said lock cylinder having an axial keyway, said lock cylinder and said casing having a plurality of rows of tumbler holes, biased tumbler means in said holes, a key insertable into said axial keyway and engageable with said tumbler means, said key having a bit section having a polygonal cross-sectional configuration formed by a plurality of polygonal faces, said first and second key hole openings having a polygonal cross-sectional configuration corresponding to said cross-sectional configuration of said bit section of said key, said first and second key holes being angularly offset relative to one another, said key having a longitudinal axis with a handle at one longitudinal end thereof, said key bit section terminating at said other longitudinal end of said key, said bit section having a plurality of ramp surfaces extending from said other longitudinal end, said ramp surfaces progressively approaching said longitudinal axis as said other longitudinal end is approached, said bit section having a plurality of notches disposed at the juncture of said polygonal faces, said bit section having a longitudinal length greater than the axial length of said keyway in said lock cylinder, said key having a shaft portion juxtaposed to said bit section and rotatable in said first key hole opening, said key being insertable into said first key hole and into said axial keyway as said ramp means and said polygonal faces engage said tumbler means, said key being subsequently rotatable in said axial keyway as said shaft portion rotates in said first key hole opening, said rotation aligning said bit section of said key with said second key hole opening to enable said bit section to be inserted into said second key hole opening, thereby effecting engagement of said notches with said tumbler means to unlock the lock.

2. A lock according to claim 1 wherein said tumbler means comprises a plurality of rows of tumblers with the number of rows corresponding to the number of polygonal faces on said bit section of said key.

3. A lock according to claim 1 wherein said tumbler means comprises a plurality of rows of tumblers with the rows being unequally angularly spaced from one another.

4. A lock according to claim 1 wherein said first polygonal keyhole is angularly offset relative to said second polygonal keyhole by 360 degrees divided by twice the number of corners of the polygon formed by said bit section.

5. A lock according to claim 1 wherein adjacent polygonal faces of said bit section are joined at polygonal edges, said notches being formed on said polygonal edges.

6. A lock according to claim 5 wherein said polygonal edges extend parallel to said longitudinal axis of said key, said notches being spaced along the longitudinal length of said polygonal edges.

7. A lock according to claim 1, further comprising an annular disk of hard metal rotatably disposed between said casing end wall and one end of said lock cylinder.

8. A lock according to claim 1 further comprising a rotatable hard metal disk disposed axially adjacent said end section of said lock cylinder.

9. A lock according to claim 1 wherein at least one of said tumbler means comprises a hard metal pin disposed in said tumbler hole in said lock cylinder, means on said lock cylinder limiting the inner radial position of said pin such that when in said inner radial direction, said pin is flush with a polygonal face of said key.

10. A lock according to claim 1 wherein said ramp surfaces have a transverse width which is less than the transverse width of the corresponding polygonal face on which the ramp surface is disposed.

11. A lock according to claim 5 wherein said polygonal edges extend to said other longitudinal end of said key.

12. A lock according to claim 1 wherein said tumbler means comprises tumbler pins and spring means biasing said pins radially inwardly, said tumbler pins having radial inner ends engageable with said ramp surfaces, with said polygonal faces and with said notches.

13. A lock according to claim 1 wherein each of said plurality of rows of tumbler means are generally aligned linearly parallel to the axis of said keyway.

14. A lock according to claim 1 wherein said tumbler means comprise axial movable tumbler pins with the axes of said tumbler pins being radially disposed.

15. A lock according to claim 1 further comprising a protective plate adapted to be fastened onto a structure to be locked, said protective plate having a recess receiving one end of the lock, said protective plate having an opening aligned with said first keyhole.

16. A lock according to claim 15 further comprising a hard metal disk rotatably mounted in said recess.

17. A lock according to claim 1 wherein said first and second keyholes are angularly offset relative to one another such that a corner of the polygonal opening of the first keyhole is axially non-aligned with a corresponding corner of the polygonal opening of the second keyhole.

18. A lock comprising an external casing, said casing having an end wall with a first keyhole opening, a lock cylinder rotatably mounted in said casing, said lock cylinder having an end section with a second keyhole opening, said lock cylinder having an axial keyway, said lock cylinder and said casing having a plurality of rows of tumbler holes, biased tumbler means in said holes, a key insertable into said axial keyway and engageable with said tumbler means, said key having a bit section having a polygonal cross-sectional configuration formed by a plurality of polygonal faces, said first and second keyhole openings having a polygonal cross-sectional configuration corresponding to said cross-sectional configuration of said bit section of said key, said first and second keyholes being angularly offset relative to one another, said key having a longitudinal axis with a handle at one longitudinal end thereof, said key bit section terminating at said other longitudinal end of said key, said bit section having a plurality of ramp surfaces extending from said other longitudinal end, said bit section having a plurality of notches disposed at the juncture of said polygonal faces, said key being insertable into said first keyhole and into said axial keyway as said ramp means and said polygonal faces engage said tumbler means, said key being subsequently rotatable in said axial keyway to align said bit section of said key with said second keyhole opening to enable said bit section to be inserted into said second keyhole opening, thereby effecting engagement of said notches with said tumbler means to unlock the lock.

* * * * *